US009472141B2

(12) United States Patent
Kikkawa

(10) Patent No.: US 9,472,141 B2
(45) Date of Patent: Oct. 18, 2016

(54) DISPLAY APPARATUS AND CONTROL METHOD THEREOF

(71) Applicant: CANON KABUSHIKI KAISHA, Tokyo (JP)

(72) Inventor: Teruki Kikkawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 263 days.

(21) Appl. No.: 14/035,029

(22) Filed: Sep. 24, 2013

(65) Prior Publication Data

US 2014/0092001 A1 Apr. 3, 2014

(30) Foreign Application Priority Data

Sep. 28, 2012 (JP) ..... 2012-216014

(51) Int. Cl.
*G09G 3/34* (2006.01)
*G09G 3/36* (2006.01)

(52) U.S. Cl.
CPC ..... *G09G 3/3406* (2013.01); *G09G 3/342* (2013.01); *G09G 3/3426* (2013.01); *G09G 2320/0233* (2013.01); *G09G 2320/0238* (2013.01); *G09G 2320/041* (2013.01); *G09G 2320/045* (2013.01); *G09G 2320/062* (2013.01); *G09G 2320/064* (2013.01); *G09G 2320/066* (2013.01); *G09G 2360/145* (2013.01); *G09G 2360/147* (2013.01); *G09G 2360/16* (2013.01)

(58) Field of Classification Search
CPC ..... G09G 2320/064; G09G 2360/16; G09G 2320/0233; G09G 2320/0238; G09G 2320/041; G09G 2320/062; G09G 2320/066; G09G 2360/147; G09G 3/3406; G09G 3/342
See application file for complete search history.

(56) References Cited

U.S. PATENT DOCUMENTS 8,363,001 B2 1/2013 Tanizoe et al.
2003/0214242 A1* 11/2003 Berg-johansen ..... G09G 3/14 315/169.3
2004/0233663 A1* 11/2004 Emslie ..... H04B 41/3927 362/221
2005/0184952 A1* 8/2005 Konno ..... G09G 3/3426 345/102
2006/0038510 A1* 2/2006 Lee ..... H02M 3/156 315/291
2006/0109389 A1* 5/2006 Ichikawa ..... G09G 3/342 349/1
2006/0118697 A1* 6/2006 Lee ..... G01J 1/32 250/205
2006/0125774 A1* 6/2006 Nishigaki ..... G09G 3/342 345/102
2006/0146005 A1* 7/2006 Baba ..... G09G 3/3233 345/102
2006/0221047 A1* 10/2006 Tanizoe ..... G09G 3/3406 345/102

(Continued)

FOREIGN PATENT DOCUMENTS

JP 2006-276725 A 10/2006
JP 2006-278107 A 10/2006

*Primary Examiner* — Michael J Eurice
(74) *Attorney, Agent, or Firm* — Fitzpatrick, Cella, Harper & Scinto

(57) ABSTRACT

A display apparatus according to the present invention includes: a backlight; a displaying unit configured to display an image on a screen by allowing the light from the backlight to be transmitted therethrough; a first measuring unit provided on a light-emitting surface of the backlight, to detect the brightness on the light-emitting surface; a correcting unit configured to correct the detection brightness which is the brightness detected by the first measuring unit; and a controlling unit configured to control the light emission brightness of the backlight. The correcting unit reduces the detection brightness by a greater reduction amount, when the image displayed in a predetermined area corresponding to a position where the first measuring unit is provided is dark, than when the image displayed in the predetermined area is bright.

12 Claims, 12 Drawing Sheets

(56) References Cited

U.S. PATENT DOCUMENTS

2007/0080923 A1* 4/2007 Enomoto ..... G09G 3/3406 345/102
2007/0091057 A1* 4/2007 Lee ..... G09G 3/3413 345/102
2007/0171670 A1* 7/2007 Zagar ..... G09G 3/3413 362/601
2007/0247415 A1* 10/2007 Yasunaga ..... G09G 3/3413 345/102
2007/0296886 A1* 12/2007 Inada ..... G02F 1/133603 349/61
2008/0030648 A1* 2/2008 Morita ..... G02F 1/133611 349/64
2008/0123022 A1* 5/2008 Aoki ..... G02F 1/133603 349/68
2008/0238341 A1* 10/2008 Korcharz ..... G09G 3/3413 315/297
2009/0001253 A1* 1/2009 Blaut ..... G09G 3/3413 250/205
2009/0091265 A1* 4/2009 Song ..... G09G 3/3413 315/185 R
2009/0109165 A1* 4/2009 Park ..... G09G 3/3426 345/102
2009/0231354 A1* 9/2009 Blaut ..... G09G 3/3413 345/589
2009/0322800 A1* 12/2009 Atkins ..... G09G 3/3413 345/690
2010/0020108 A1* 1/2010 Cho ..... G09G 3/3406 345/690
2010/0045190 A1* 2/2010 Cramer ..... H05B 33/0854 315/151
2010/0245227 A1* 9/2010 Chen ..... G09G 3/3426 345/102
2010/0259572 A1* 10/2010 Yang ..... G09G 3/3413 345/697
2011/0063214 A1* 3/2011 Knapp ..... H04L 12/43 345/158

* cited by examiner

FIG. 2

| DIVIDED AREA | STANDARD PWM CONTROL VALUE |
|---|---|
| 1 | 8000 |
| 2 | 7500 |
| 3 | 8250 |
| 4 | 8500 |
| 5 | 8000 |
| : | : |
| : | : |
| : | : |
| 60 | 7920 |

FIG. 3

| DIVIDED AREA | STANDARD DETECTION BRIGHTNESS |
|---|---|
| 1 | 500 |
| 2 | 550 |
| 3 | 520 |
| 4 | 560 |
| 5 | 530 |
| : | : |
| : | : |
| : | : |
| 60 | 600 |

FIG. 7

| CHARACTERISTIC VALUE (APL) | CORRECTION COEFFICIENT |
|---|---|
| 1 | 0.8 |
| 2 | 0.82 |
| 3 | 0.83 |
| 4 | 0.85 |
| 5 | 0.89 |
| : | : |
| : | : |
| : | : |
| 253 | 1.46 |
| 254 | 1.48 |
| 255 | 1.52 |

FIG. 9A

T=20°C

| CHARACTERISTIC VALUE (AVERAGE GRADATION VALUE) | CORRECTION COEFFICIENT | | |
|---|---|---|---|
| | R | G | B |
| 1 | 0.79 | 0.81 | 0.83 |
| 2 | 0.81 | 0.82 | 0.85 |
| 3 | 0.83 | 0.84 | 0.87 |
| 4 | 0.85 | 0.85 | 0.88 |
| 5 | 0.87 | 0.88 | 0.88 |
| : | : | : | : |
| : | : | : | : |
| : | : | : | : |
| 253 | 1.44 | 1.44 | 1.47 |
| 254 | 1.46 | 1.49 | 1.50 |
| 255 | 1.47 | 1.51 | 1.53 |

FIG. 9B

T=40°C

| CHARACTERISTIC VALUE (AVERAGE GRADATION VALUE) | CORRECTION COEFFICIENT | | |
|---|---|---|---|
| | R | G | B |
| 1 | 0.78 | 0.8 | 0.81 |
| 2 | 0.80 | 0.81 | 0.83 |
| 3 | 0.81 | 0.82 | 0.84 |
| 4 | 0.83 | 0.84 | 0.85 |
| 5 | 0.85 | 0.86 | 0.89 |
| : | : | : | : |
| : | : | : | : |
| : | : | : | : |
| 253 | 1.42 | 1.43 | 1.46 |
| 254 | 1.46 | 1.48 | 1.49 |
| 255 | 1.48 | 1.50 | 1.52 |

FIG. 9C

T=60℃

| CHARACTERISTIC VALUE (AVERAGE GRADATION VALUE) | CORRECTION COEFFICIENT | | |
|---|---|---|---|
| | R | G | B |
| 1 | 0.70 | 0.75 | 0.77 |
| 2 | 0.72 | 0.77 | 0.78 |
| 3 | 0.73 | 0.79 | 0.80 |
| 4 | 0.75 | 0.80 | 0.81 |
| 5 | 0.79 | 0.81 | 0.83 |
| : | : | : | : |
| : | : | : | : |
| : | : | : | : |
| 253 | 1.30 | 1.37 | 1.39 |
| 254 | 1.33 | 1.39 | 1.41 |
| 255 | 1.36 | 1.43 | 1.44 |

DISPLAY APPARATUS AND CONTROL METHOD THEREOF

BACKGROUND OF THE INVENTION

1. Field of the Invention

The present invention relates to a display apparatus and a control method of the display apparatus.

2. Description of the Related Art

A liquid crystal display apparatus is a display apparatus using the light transmissivity of a liquid crystal panel, and displays an image by allowing light, exited from a light emitting unit (backlight) that is provided on a back surface of a liquid crystal panel, to be transmitted through the liquid crystal panel or to be blocked by the liquid crystal panel.

According to a general transmissive liquid crystal panel, voltage is applied between transparent conductive films formed on two glass substrate modules, and the alignment of liquid crystal in a liquid crystal layer provided between the substrates is controlled. The transmissive liquid crystal panel functions as a liquid crystal shutter by actions of the liquid crystal layer, and a polarizing plate and a light distribution film that are provided on the front and the back of the liquid crystal layer. As the light emitted from the backlight is mostly absorbed by the light distribution film and the polarizing plate, light utilization efficiency is as low as several percent. The light utilization efficiency is the ratio of the light transmitted through the liquid crystal panel, to the light emitted from the backlight, for example.

In recent years, however, a liquid crystal panel having high light utilization efficiency has been developed, such as a liquid crystal panel of a micro electro-mechanical-systems (MEMS) shutter type, a scattering type or the like. There is a liquid crystal panel using polymer dispersed liquid crystal (PDLC) that allows small particles of nematic liquid crystal to be dispersed in polymer material, for example. In the polymer dispersed liquid crystal, the refractive index difference between the polymer material and the nematic liquid crystal is controlled by a voltage. By controlling the refractive index difference, the scattered state and the unscattered state are switched with each other. In other words, by controlling the refractive index difference, the polymer dispersed liquid crystal functions as the liquid crystal shutter. Therefore, such a liquid crystal panel does not require the polarizing plate and the light distribution film, and is able to obtain a light utilization efficiency as high as about 60 to 80 percent.

In the backlight, a plurality of light-emitting diodes (hereinafter referred to as LEDs) are used as light sources. The LEDs to be used as the light sources include, for example, a white LED as W (white), and color LEDs as R (red), G (green) and B (blue). Methods of adjusting the light emission brightness and the light emission color of each LED include a method of controlling a current value or a voltage value to be applied (PHM control), a method of controlling the application time of the current or voltage (that is, a light emission period of the LED) (PWM control), a method of performing both of the PHM control and the PWM control, and the like. By performing the PHM control and the PWM control, it is possible to obtain light having the desired light emission brightness and light having a desired color (white balance).

However, the brightness of the LEDs changes due to temperature characteristics and aging degradation. In addition, as the LEDs possess individual differences, the light emission brightness is different among the LEDs when the plurality of LEDs are driven under the same condition. In view of the above, such technology has been proposed that a brightness sensor provided inside a backlight housing is used to perform feed-back control of the light emission brightness of the backlight, in order to maintain the light emission brightness of the backlight constantly (for example, Japanese Patent Application Laid-open No. 2006-278107 and Japanese Patent Application Laid-open No. 2006-276725).

In order to perform feed-back control so that the light emission brightness of the backlight is maintained constantly, it is necessary to accurately detect the light emission brightness of the backlight (amount of light emission of the LEDs). However, the brightness sensor provided inside the backlight housing detects light containing direct light from the backlight (LEDs) and return light from the liquid crystal panel (reflected light that is reflected and returned from the liquid crystal panel, scattered light that is propagated and scattered in the liquid crystal panel and is returned back from the liquid crystal panel, and the like).

According to the general transmissive liquid crystal panel, the light emitted from the backlight is mostly absorbed by the polarizing plate and the light distribution film, and the return light from the liquid crystal panel is returned in minute amounts. Therefore, ignoring the brightness of the return light contained in the brightness detected by the brightness sensor does not present a big problem. However, according to a liquid crystal panel having the high light utilization efficiency, the ratio of the return light to the light detected by the brightness sensor increases, as the liquid crystal panel does not include the polarizing plate and the light distribution film. In addition, the ratio of the return light changes significantly, as the scattered light from the liquid crystal panel changes significantly, depending on a light distribution state of the liquid crystal corresponding to an image to be displayed (a transmission state and a blocking state, for example). In other words, a brightness value acquired in the brightness sensor changes, depending on the image to be displayed, even when the light emission brightness of the backlight does not change. For this reason, according to the liquid crystal panel having the high light utilization efficiency, it is not possible to ignore the brightness of the return light that is contained in the brightness detected by the brightness sensor.

As the above-described conventional technology does not give consideration to the return light from the liquid crystal panel, it is not possible to detect the light emission brightness of the backlight (the amount of light emission of the LEDs) with high precision. According to the liquid crystal display apparatus having the liquid crystal panel with the high light utilization efficiency, in particular, it is not possible to detect the light emission brightness of the backlight with high precision. For this reason, accurate feed-back control may not be made, and the light emission brightness of the backlight may not be maintained constantly.

SUMMARY OF THE INVENTION

The present invention provides technology capable of detecting the light emission brightness of a backlight with high precision, and of maintaining the light emission brightness of the backlight constantly.

The present invention according to a first aspect provides a display apparatus comprising:

a backlight configured to emit light;

a displaying unit configured to display an image on a screen by allowing the light from the backlight to be transmitted therethrough at a transmittance based on an image signal;

a first measuring unit provided on a light-emitting surface of the backlight, to detect the brightness on the light-emitting surface;

a correcting unit configured to correct the detection brightness which is the brightness detected by the first measuring unit, based on the brightness of the image displayed in a predetermined area corresponding to a position where the first measuring unit is provided; and a controlling unit configured to control light emission brightness of the backlight so that the detection brightness after correction by the correcting unit coincides with a predetermined target value. The correcting unit reduces the detection brightness by a greater reduction amount, when the image displayed in the predetermined area is dark, than when the image displayed in the predetermined area is bright.

The present invention according to a second aspect provides a control method of a display apparatus including a backlight configured to emit light, a displaying unit configured to display an image on a screen by allowing the light from the backlight to be transmitted therethrough at a transmittance based on an image signal, and a first measuring unit provided on a light-emitting surface of the backlight, to detect the brightness on the light-emitting surface. The control method comprises the steps of:

correcting the detection brightness which is the brightness detected by the first measuring unit, based on the brightness of the image displayed in a predetermined area corresponding to a position where the first measuring unit is provided; and controlling the light emission brightness of the backlight so that the detection brightness after correction in the correcting step coincides with a predetermined target value. In the correcting step, the detection brightness is reduced by a greater reduction amount, when the image displayed in the predetermined area is dark, than when the image displayed in the predetermined area is bright.

According to the present invention, it is possible to detect the light emission brightness of the backlight with high precision, and to maintain the light emission brightness of the backlight constantly.

Further features of the present invention will become apparent from the following description of exemplary embodiments with reference to the attached drawings.

BRIEF DESCRIPTION OF THE DRAWINGS

FIG. 2 is a view showing an example of a standard PWM control value table according to the first embodiment;

FIG. 3 is a view showing an example of a standard detection brightness table according to the first embodiment;

FIG. 7 is a view showing an example of a correction coefficient table according to the first embodiment;

FIGS. 9A to 9C are views showing example of correction coefficient table according to the second embodiment.

DESCRIPTION OF THE EMBODIMENTS

Hereinafter, embodiments of the present invention will be illustratively explained in detail with reference to the drawings. It should be noted that functions, relative positions and the like of components described in the embodiments are not intended to limit the scope of the invention, unless specifically described. Functions, shapes and the like of the structure and components that are explained once in the following description are the same throughout the description, unless otherwise specified.

First Embodiment

A display apparatus and a control method according to a first embodiment of the present invention will be explained.

Figure 1:
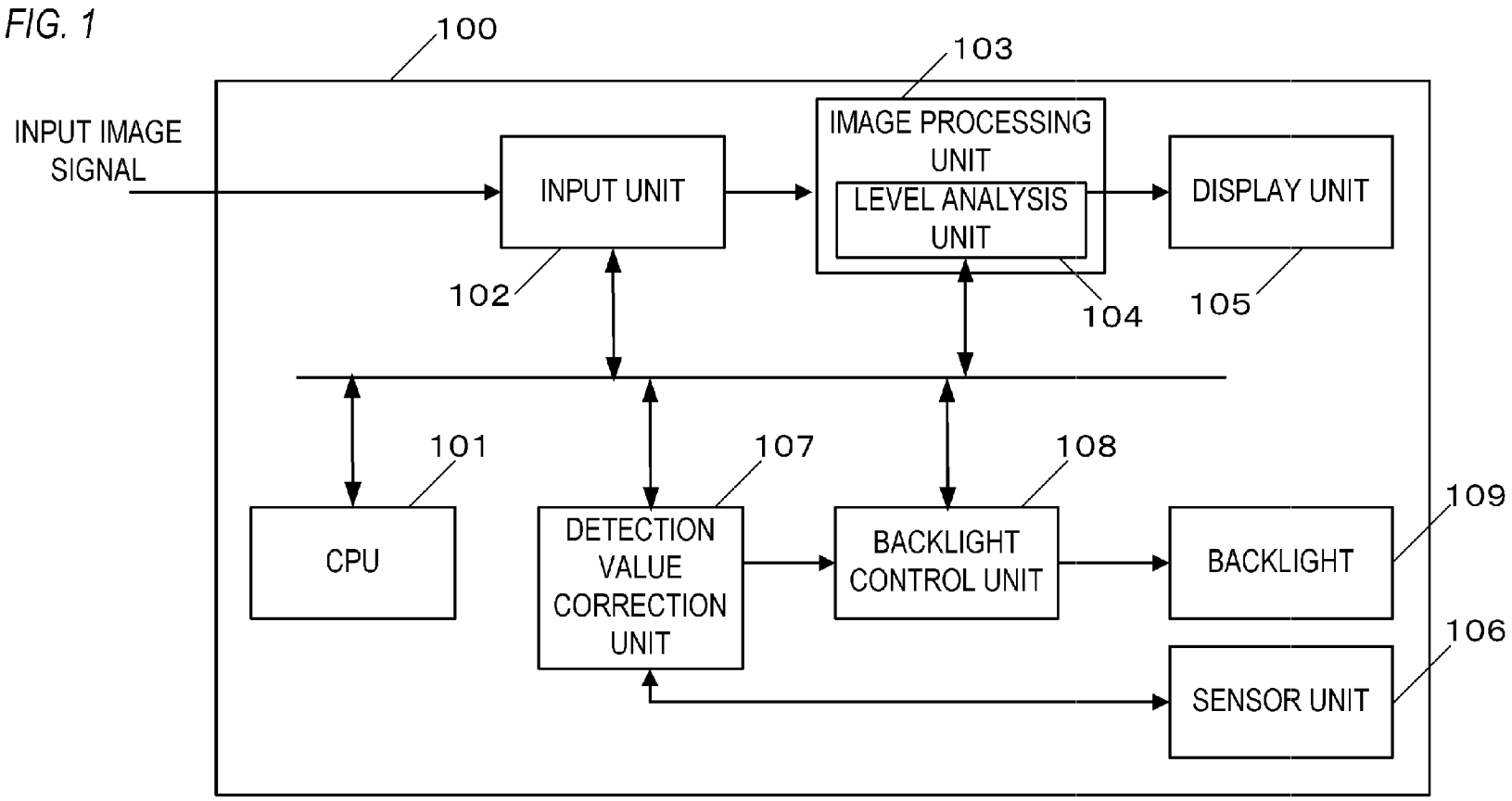
FIG. 1 is a block diagram showing an example of function structure of a display apparatus according to first and second embodiments.

FIG. 1 is a block diagram showing an example of function structure of a display apparatus 100 according to the first embodiment.

A ROM and a RAM are connected to a CPU 101. According to programs stored in the ROM, the CPU 101 uses the RAM as a work memory and controls the operation of the entire display apparatus 100. An input unit 102 decodes image data (input image signal; input image data) that is inputted from a not-shown image output apparatus, and outputs the decoded image data to an image processing unit 103.

The image processing unit 103 subjects the image data inputted from the input unit 102 to image processing (image quality improvement processing and the like) as required, and outputs the image data to a display unit 105. Further, the image processing unit 103 has a level analysis unit 104. The level analysis unit 104 acquires a characteristic value of the image data inputted from the input unit 102. The characteristic value is a value showing the brightness (luminance) of the image, which is, for example, a pixel value of the image data (pixel values of respective pixels, a representative value of the pixel values or the like), a brightness value (brightness values of the respective pixels, a representative value of the brightness values or the like) or the like. The representative value is, for example, a maximum value, a minimum value, a mode value, an intermediate value, a mean value or the like. According to this embodiment, an average brightness level (APL: Average Picture Level) is acquired as the characteristic value. The image processing unit 103 (level analysis unit 104) outputs the acquired characteristic value to a detection value correction unit 107. Incidentally, the characteristic value may be acquired by the analysis of the image data, or may be acquired from the outside. Further, the level analysis unit 104 may be provided separately from the image processing unit 103. The level analysis unit 104 may be provided inside the detection value correction unit 107.

The display unit 105 is a display panel that causes light from a later-described backlight 109 to be transmitted therethrough at a transmittance based on the input image signal (transmittance according to the image data inputted from the image processing unit 103) and causes the image to be displayed on a screen. The display unit 105 may be a liquid crystal panel, for example.

It should be noted that the display unit 105 is not limited to the liquid crystal panel. Any display panel may be used as long as the light is transmitted through the display panel to display the image.

A sensor unit 106 has a brightness sensor (first measurement unit) and a temperature sensor (second measurement unit). The sensor unit 106 (the brightness sensor and the temperature sensor) is provided on a light-emitting surface of the backlight 109. The brightness sensor detects the brightness on the light-emitting surface of the backlight 109. The temperature sensor detects a temperature in the vicinity of the brightness sensor. The sensor unit 106 outputs detection values (the brightness detected by the brightness sensor (detection brightness), and the temperature detected by the temperature sensor (detection temperature)) to the detection value correction unit 107.

The detection value correction unit 107 corrects the detection brightness based on the brightness of the image that is displayed in a predetermined area (corresponding area) corresponding to the position where the brightness sensor is provided, out of areas in the screen. Specifically, the detection value correction unit 107 corrects the detection brightness that is inputted from the sensor unit 106, based on the characteristic value that is inputted from the image processing unit 103. Then, the detection value correction unit 107 outputs the corrected detection brightness (detection brightness after correction) to a backlight control unit 108. Details of the method of correcting the detection brightness will be explained later.

Incidentally, the detection value correction unit 107 may correct the detection brightness based on the detection temperature of the temperature sensor, in consideration of temperature characteristics of the brightness sensor (changes in the detection brightness by the temperature).

The backlight control unit 108 controls light emission brightness of the backlight 109 so that the light emission brightness of the backlight 109 is maintained constantly. Specifically, the backlight control unit 108 controls the light emission brightness (PWM control value) of the backlight 109 so that the detection brightness after correction coincides with a predetermined target value. More specifically, the backlight control unit 108 reads out a standard PWM control value as a standard value of the PWM control value, and standard detection brightness as the predetermined target value, from the ROM. Based on the standard PWM control value, the standard detection brightness, and the detection brightness after correction, the backlight control unit 108 determines the PWM control value, and outputs the determined PWM control value to the backlight 109.

Incidentally, the backlight control unit 108 may control the PWM control value based on the detection temperature of the temperature sensor, in consideration of the temperature characteristics of the brightness sensor (changes in the light emission brightness by the temperature).

The backlight 109 is a light emitting unit that emits light having the light emission brightness corresponding to the PWM control value inputted from the backlight control unit 108. Incidentally, it is assumed that the backlight 109 has the structure capable of controlling the light emission brightness for each of divided areas that are obtained by dividing the screen, according to this embodiment, but this is not restrictive. The backlight 109 may have a structure incapable of changing the light emission brightness partially (the structure capable of controlling the light emission brightness of the entire backlight only).

FIG. 2 is a view showing an example of a standard PWM control value table that is stored in the ROM in advance. The standard PWM control value table is a table showing the standard PWM control values for the respective divided areas. The standard PWM control values of the respective divided areas are values determined during manufacturing the display apparatus so that the brightness of the light from the backlight 109 becomes uniform in the screen.

FIG. 3 is a view showing an example of a standard detection brightness table that is stored in the ROM in advance. The standard detection brightness table is a table showing the standard detection brightness for the respective divided areas. The standard detection brightness is the detection brightness when the backlight 109 is allowed to emit light according to the standard PWM control values for the respective divided areas.

The backlight control unit 108 determines the PWM control value of each divided area by using the standard PWM control value and the standard detection brightness of the divided area, for each of the divided areas. Then, the backlight control unit 108 drives the backlight 109 (light sources of the backlight 109) with the PWM control value determined for each of the divided areas.

Incidentally, the target value of the detection brightness after correction may be a fixed value, or a changeable value. For example, the display apparatus 100 may have a plurality of modes (image quality modes) having the different target values of the detection brightness after correction. Then, the light emission brightness (PWM control value) may be controlled so that the detection brightness after correction coincides with the target value corresponding to the set mode.

Further, the PWM control values may be updated at any timing. For example, the PWM control values may be updated at predetermined time intervals. According to this embodiment, a vertical synchronizing signal, when the image processing unit 103 outputs the image data to the display unit 105, is inputted to the backlight control unit 108. Then, the backlight control unit 108 updates the PWM control values in response to the input of the vertical synchronizing signal. In other words, the PWM control values are updated for each frame of the image to be displayed.

Figure 4:
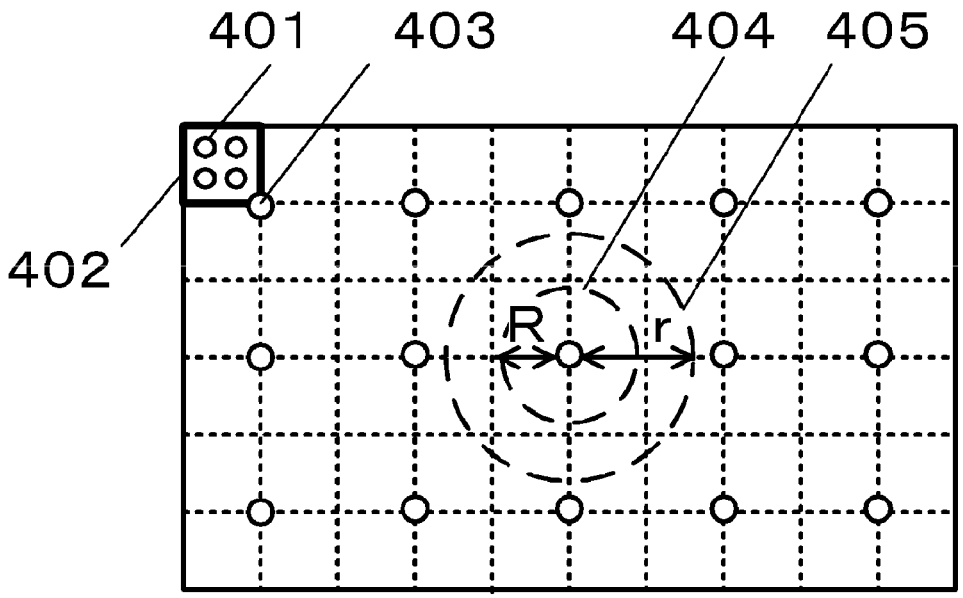
FIG. 4 is a view showing an example of the structure of a backlight according to the first embodiment.

FIG. 4 is a view showing an example of the structure of the backlight 109.

According to this embodiment, the backlight 109 has W (white) LEDs 401 as the light sources. Specifically, the backlight 109 has the four WLEDs 401 in each of the divided areas 402. In the example shown in FIG. 4, the screen is divided into 60 divided areas in total, that is, 10 divided areas in a horizontal direction×six divided areas in a vertical direction. Further, the backlight 109 has one sensor unit 403 (sensor unit 106; the brightness sensor and the temperature sensor) for each group of the two divided areas in the horizontal direction×the two divided areas in the vertical direction. The detection value of one sensor unit 403 is associated with the four divided areas corresponding to the sensor unit 403.

Incidentally, the light source of the backlight 109 is not limited to the LED. For example, an organic EL device, a cold-cathode tube or the like may be used as the light source. Further, the number of the light sources corresponding to one divided area is not limited to four. The number of the light sources corresponding to one divided area may be greater than or smaller than four, such as one, three, five or the like.

Incidentally, the number of the divided areas is not limited to 60. The number of the divided areas may be greater than or smaller than 60, such as 15 in total, that is, five in the horizontal direction×three in the vertical direction, 240 in total, that is, 20 in the horizontal direction×12 in the vertical direction or the like. Further, the divided areas are not limited to the ones obtained by dividing the screen in matrix.

The display unit 105 has the characteristic of returning at least a part of the light from the backlight 109 to the backlight side. Here, the light returned from the display unit 105 back to the backlight 109 side is referred to as "return light".

The brightness sensor in the sensor unit 403 detects the brightness of combined light of direct light from the WLEDs 401 and the return light from the display unit 105. Specifically, the brightness of the combined light of the direct light from the WLEDs in an area 404 and reflected light from an area 405 in the display unit 105 is detected. The area 404 is an area having a radius R centering on the position of the brightness sensor, on a surface parallel to the screen. The area 405 is an area having a radius r centering on the position of the brightness sensor, on the surface parallel to the screen.

Figure 5A:
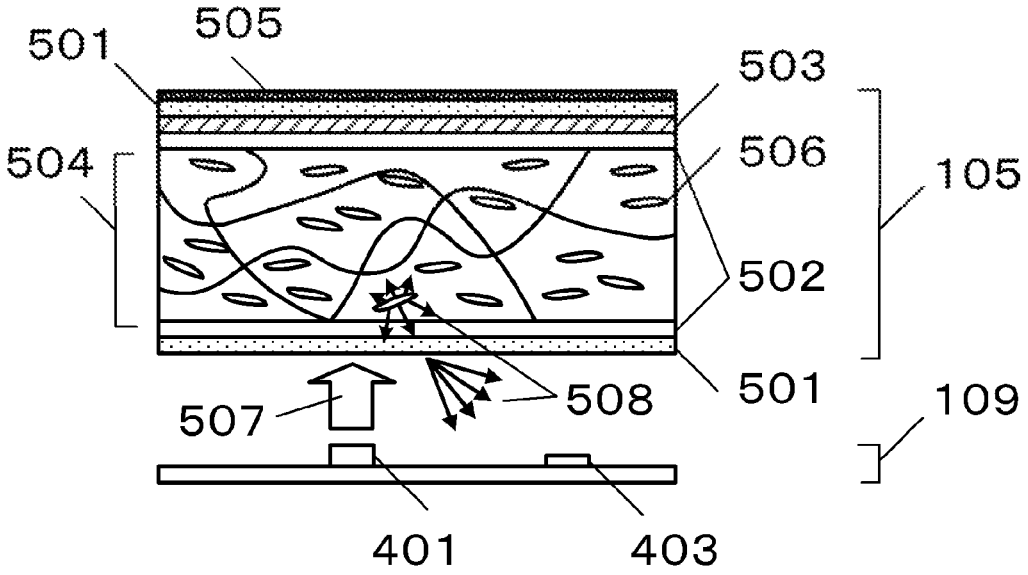
FIGS. 5A and 5B are views schematically showing the cross section of a display unit and the backlight according to the first embodiment.
Figure 5B:
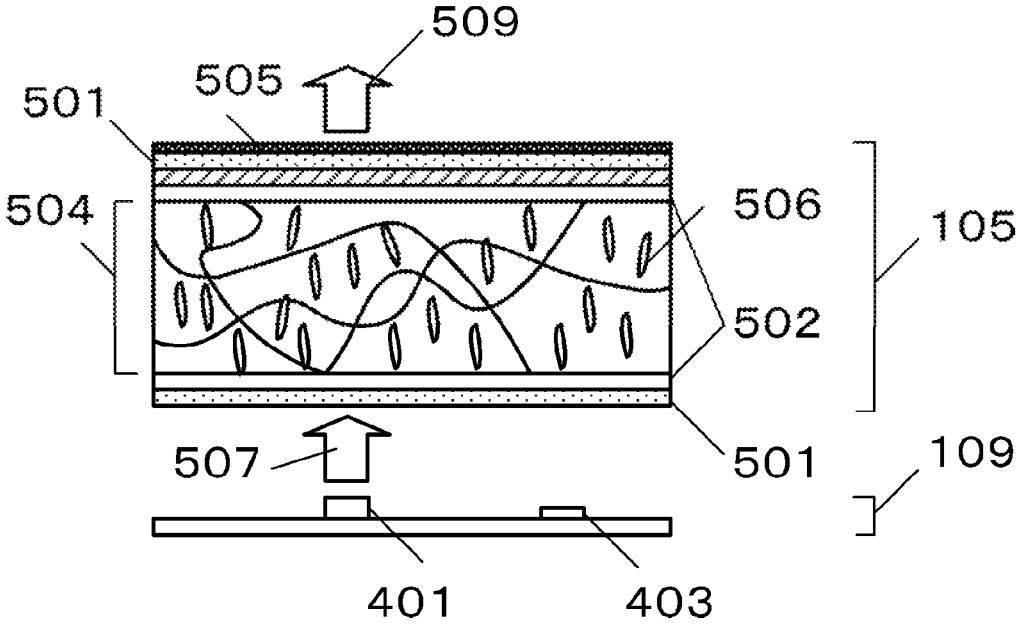

FIGS. 5A and 5B are views schematically showing the cross section of the display unit 105 and the backlight 109. According to this embodiment, one pixel in the display unit 105 is formed by a plurality of subpixels whose displaying colors are different from each other. FIGS. 5A and 5B show the structure of one subpixel in the display unit 105.

The display unit 105 includes glass substrates 501, a pair of counter electrodes 502 that are provided on the glass substrates 501, a color filter 503 that is provided on the counter electrode, and a liquid crystal layer 504 that is disposed between the counter electrodes. In addition, a polarizing plate 505 is provided on the color filter 503 so as to scatter incident light from a display surface and block exit light from the inside of the display apparatus, at the time of displaying an image with low brightness, such as when displaying a black image.

When displaying the image, voltage corresponding to the image data (image signal) is applied to the counter electrodes 502.

FIG. 5A shows the state where the voltage is not applied to the counter electrodes 502 (hereinafter referred to as a powered-off state), and FIG. 5B shows the state where the voltage is applied to the counter electrodes 502 (hereinafter referred to as a powered-on state).

During the powered-off state, as shown in FIG. 5A, liquid crystal molecules 506 inside the liquid crystal layer 504 are directed to different directions. Therefore, the light from the LED 401 (incident light 507) is scattered, and the scattered light exits from the backlight 109 side of the display unit 105, as return light 508.

During the powered-on state, as shown in FIG. 5B, the liquid crystal molecules 506 are oriented perpendicularly to the electrodes, and therefore, the incident light 507 is transmitted through the liquid crystal layer 504, without being scattered, and exited from the screen as exit light 509.

It is clear from FIGS. 5A and 5B that the light containing the return light is detected by the brightness sensor, during the powered-off state. In actuality, the display unit 105 is neither in the powered-on state nor in the powered-off state. In the display unit 105, an application amount of the voltage is controlled according to the image data. Thereby, a degree of orientation of the liquid crystal molecules 506 is controlled, and the transmittance of the display unit 105 (exit light 509/incident light 507) is controlled. Therefore, the amount of the return light changes depending on the image data to be displayed, and a brightness detection value is changed.

Specifically, in an area where a dark image is displayed, out of the areas in the screen, the light whose amount is greater than that in an area where a bright image is displayed is returned back to the backlight side.

For this reason, the detection brightness is corrected so that the change in the detection brightness due to the return light is corrected, according to this embodiment.

Figure 6:
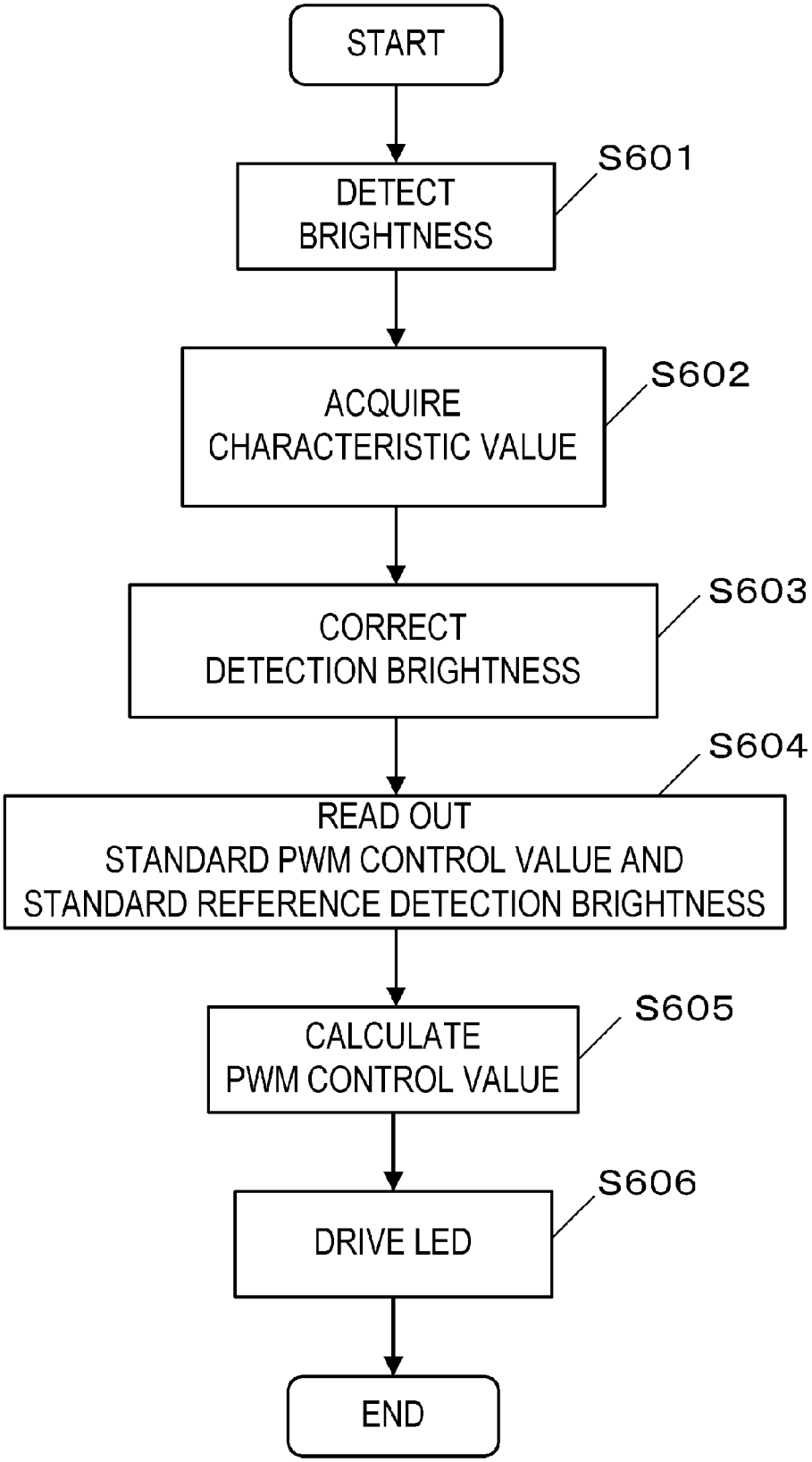
FIG. 6 is a flowchart showing an example of feed-back control according to the first embodiment.

FIG. 6 is a flowchart showing an example of feed-back control according to this embodiment.

First, the brightness sensor in the sensor unit 403 detects the brightness at the timing after when the PWM control values are updated (S601). As described above, the backlight control unit 108 updates the PWM control values at the timing of the vertical synchronizing signal when the image processing unit 103 outputs the image data to the display unit 105, and drives the LEDs, according to this embodiment. After the LEDs are driven, the brightness sensor detects the brightness at the timing when drive voltage for driving the LEDs is stabilized.

Next, the level analysis unit 104 acquires the characteristic value of the image, as the brightness of the image to be displayed in the corresponding area of the brightness sensor, for each of the brightness sensors (S602). According to this embodiment, the APL of the image to be displayed in the corresponding area is acquired. The corresponding area is set as the area where the return light, affecting the detection brightness, is caused (the area 405 having the radius r in FIG. 4). According to the embodiment, a circular area centering on the position where the brightness sensor is provided is set as a corresponding area.

Incidentally, the size of the corresponding area may have a fixed value, or a changeable value. For example, the radius r in FIG. 4 is increased as the light emission brightness of the backlight 109 increases. Therefore, it is preferable that the corresponding areas are set in advance for the respective image quality modes. For example, it is preferable that corresponding area information, in which an image quality mode whose target value is as low as 100 cd/m$^2$ is associated with a corresponding area having a radius r1, and an image quality mode whose target value is as high as 500 cd/m$^2$ is associated with a corresponding area having a radius r2 (>r1), is stored in the ROM in advance. Further, it is preferable that the level analysis unit 104 sets the corresponding area associated with the set image quality mode. Thereby, when the target value corresponding to the set image quality mode is high, the corresponding area, whose size is larger than that of when the target value corresponding to the set image quality mode is low, is set. This makes it possible to accurately set the area, where the return light, affecting the detection brightness, is caused, as the corresponding area, and also to correct the change in the detection brightness due to the return light with higher precision.

Incidentally, the corresponding area may not have the circular shape. The shape of the corresponding area may be, for example, a polygon (such as a quadrilateral) or the like. Further, the central position of the corresponding area may not be in agreement with the position where the brightness sensor is provided.

Then, the detection value correction unit 107 corrects the brightness (detection brightness) detected in S601, by using a correction coefficient corresponding to the characteristic value acquired in the S602, for each of the brightness sensors (S603). According to this embodiment, the detection brightness is corrected by using the Expression 1.

(Detection brightness after correction)=(Detection brightness)×(Correction coefficient) (Expression 1)

FIG. 7 shows an example of a correction coefficient table that is used for correcting the detection brightness. The correction coefficient table is a table (or a function) showing the correction coefficients for the respective characteristic values. In the example shown in FIG. 7, the correction coefficient for the intermediate value (intermediate gradation value) of a possible range of the APL is defined as 1.0, and the correction coefficient is reduced as the value of the APL is reduced, by giving consideration to the influence of the return light 508 to the detection brightness. Thus, when the image to be displayed in the corresponding area is dark, according to this embodiment, the detection brightness is reduced by a greater reduction amount than a reduction amount of when the image to be displayed in the corresponding area is bright. This is because the amount of the return light is greater when the dark image is displayed, than when the bright image is displayed.

Incidentally, the detection brightness is multiplied by the correction coefficient according to this embodiment, but the correction method is not limited to the above. Any method may be used to correct the detection brightness, as long as the detection brightness is reduced by the greater reduction amount when the image to be displayed in the corresponding area is dark, than the reduction amount of when the image to be displayed in the corresponding area is bright. For example, a correction value corresponding to the acquired characteristic value may be added to or subtracted from the detection brightness.

Next, the backlight control unit 108 reads out the standard PWM control value and the standard detection brightness for each of the divided areas, from the ROM (S604).

Then, the backlight control unit 108 calculates a PWM control value for each of the divided areas, by using the standard PWM control value, the standard detection brightness, and the detection brightness after correction (S605). According to this embodiment, the PWM control value is calculated by using the Expression 2.

(PWM control value)=(Reference PWM control value)×((Reference detection brightness)/(Detection brightness after correction)) (Expression 2)

Next, the backlight control unit 108 drives the LEDs in the backlight 109 by using the PWM control value for each of the divided areas that is calculated in the S605 (S606).

According to this embodiment as described thus far, the detection brightness of the brightness sensor is corrected by giving consideration to the change in the amount of the return light, depending on the brightness of the image. Thus, it is possible to detect the light emission brightness of the backlight (the brightness of the light directly inputted from the backlight to the brightness sensor) with high precision. As the light emission brightness of the backlight is controlled based on the corrected detection brightness, it is possible to constantly maintain the light emission brightness of the backlight.

Second Embodiment

According to a second embodiment, an example of using a plurality of light sources, having different colors of emitting light (light emission colors), as the light sources of the backlight will be explained.

Figure 8:
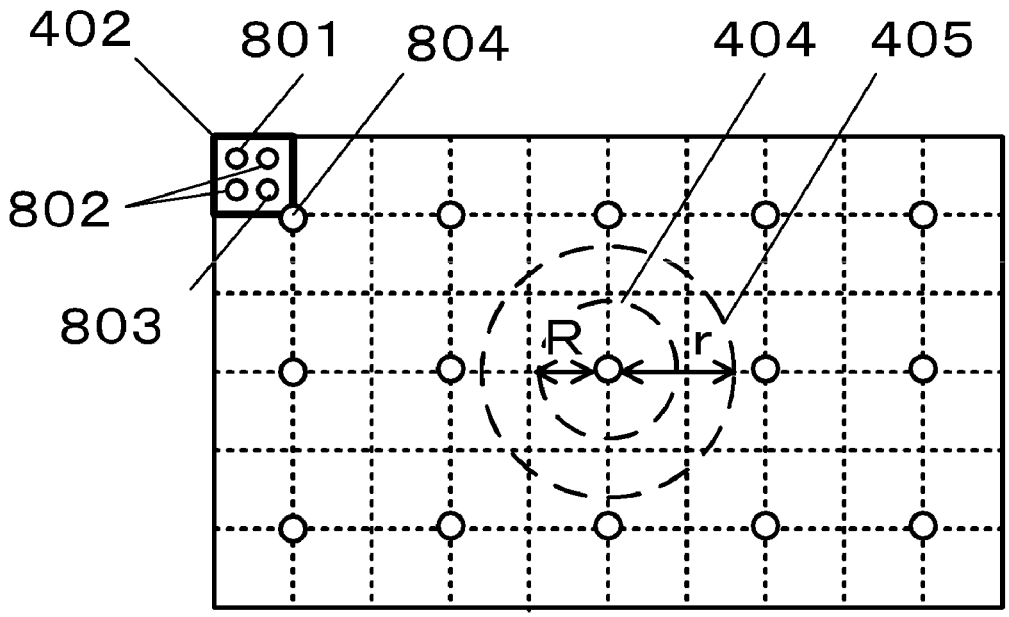
FIG. 8 is a view showing an example of the structure of the backlight according to the second embodiment.

FIG. 8 is a view showing an example of the structure of the backlight 109 according to the second embodiment.

According to this embodiment, the backlight 109 has three kinds of color LEDs of R (red) LEDs 801, G (green) LEDs 802, and B (blue) LEDs 803, as the light sources. Specifically, the backlight 109 has the four color LEDs (one RLED 801, two GLEDs 802, and one BLED 803) that are arranged in matrix, for each of the divided areas 402.

A sensor unit 804 (sensor unit 106) has the brightness sensor and the temperature sensor. According to this embodiment, the brightness sensor detects the brightness on the light-emitting surface of the backlight 109 for each of the light emission colors of the light sources. The brightness sensor is, for example, a color sensor in which a photodiode and optical filters of the respective colors are combined.

Incidentally, the light sources are not limited to the RLED, the GLED, and the BLED. For example, a Y (yellow) LED may be used as the light source.

According to this embodiment, the detection brightness is corrected for each of the colors of the light emitted by the light sources, based on the brightness of the colors of the image to be displayed in the corresponding area.

The level analysis unit 104 acquires the characteristic value showing the brightness of the light emission color in the image displayed in the corresponding area, for each of the light emission colors. Specifically, the level analysis unit 104 generates a histogram of the image displayed in the corresponding area, for each of the three colors of R, G and B (color components), from the inputted image data. According to this embodiment, a histogram of the R value, a histogram of the G value, and a histogram of the B value are generated. Then, the level analysis unit 104 calculates an average gradation value as the characteristic value, for each of the colors, by using the histogram. According to this embodiment, a mean value of the R value, a mean value of the G value, and a mean value of the B value are calculated as the characteristic values.

Then, the detection value correction unit 107 corrects the detection brightness of the light emission color based on the characteristic value of the light emission color (the characteristic value acquired by the level analysis unit 104) for each of the light emission colors.

Incidentally, the spectral characteristics and the light emission intensity of the light emitted by the color LEDs, whose light emission colors are different from each other, are different from each other. As a result of this, the light absorption amounts and the scattering conditions of the color LEDs, whose light emission colors are different from each other, are different from each other in the display unit 105, and the areas where the return light that affects the detection brightness is caused (areas on the screen) are also different from each other. For this reason, it is preferable that the corresponding areas with different sizes are set for the respective light emission colors. For example, according to this embodiment, the ratio of the light emission intensity is set as GLED:RLED:BLED=6:3:1, in order to realize standard white light. Further, the corresponding areas for the respective light emission colors are set so that the relationship of $r_B<r_R<r_G$ is realized. The r_R is the corresponding area corresponding to R. The r_G is the corresponding area corresponding to G. The r_B is the corresponding area corresponding to B. This makes it possible to accurately set the area where the return light that affects the detection brightness is caused as the corresponding area, for each of the light emission colors, and to correct the change in the detection brightness due to the return light with higher precision.

Further, the scattering characteristics of the display unit 105 change depending on the temperature characteristics of the liquid crystal layer 504. Therefore, the amount of return light changes depending on the temperature of the display unit 105, and the brightness detection value changes. Specifically, polymers used in scattering type liquid crystal have such a characteristic that the light is hardly transmitted therethrough when the temperature increases. When the display unit 105 is a display panel using such material, a greater amount of light is returned back to the backlight side in the area where the temperature is high, as compared with the area where the temperature is low, among the areas in the screen.

Therefore, according to this embodiment, the correction coefficient is changed according to the detection temperature of the temperature sensor. Specifically, a plurality of correction coefficients (a plurality of correction coefficients corresponding to a plurality of detection temperatures), in which the correction coefficients are reduced when the detection temperature is high than when the detection temperature is low, are stored in the ROM in advance. Based on the detection temperature, the detection value correction unit 107 determines the correction coefficient to be used, out of the plurality of correction coefficients. Thus, when the temperature detected by the temperature sensor is high, the detection brightness is reduced by a greater reduction amount than a reduction amount of when the temperature detected by the temperature sensor is low.

Incidentally, only the correction coefficient corresponding to a standard temperature Tc may be provided in advance. The correction coefficient to be used may be calculated from the correction coefficient corresponding to the standard temperature Tc and the detection temperature.

Incidentally, the temperature inside the display apparatus (such as the temperature of the backlight) changes according to the light emission brightness of the backlight. In other words, the temperature inside the display apparatus changes according to the target value of the detection brightness after correction. Therefore, the correction coefficient may be changed according to the target value of the detection brightness.

FIG. 9A is a view showing example of correction coefficient table corresponding to the temperature of T=20° C. FIG. 9B is a view showing example of correction coefficient table corresponding to the temperature of T=40° C. FIG. 9C is a view showing example of correction coefficient table corresponding to the temperature of T=60° C. According to this embodiment, the correction coefficient tables show the correction coefficients for R, the correction coefficients for G, and the correction coefficients for B, for the respective characteristic values.

During the feed-back control, the temperature sensor detects the temperature in the vicinity of the brightness sensor. Then, based on the detected temperature (detection temperature), the acquired characteristic value, and the correction coefficient table, the detection value correction unit 107 calculates the correction coefficient to be used for correcting the detection brightness, for each of the light emission colors. According to this embodiment, the correction coefficient is calculated by linear interpolation processing, as shown in the Expression 3.

$$(\text{Sensor correction coefficient})=((Cb-Ca)/(Tb-Ta))\times(Tp-Ta)+Ca \quad \text{(Expression 3)}$$

Where, Tp is the detection temperature, Ta is the temperature lower than Tp, out of a plurality of temperatures corresponding to a plurality of correction coefficient tables, Tb is the temperature higher than Tp, out of the plurality of temperatures corresponding to the plurality of correction coefficient tables, Ca is the correction coefficient corresponding to the acquired characteristic value in the correction coefficient table corresponding to Ta, and Cb is the correction coefficient corresponding to the acquired characteristic value in the correction coefficient table corresponding to Tb.

Incidentally, it is preferable that Ta and Tb are the temperatures closest to Tp.

When the correction coefficient table corresponding to Tp is provided, the correction coefficient in the correction coefficient table may be acquired as the correction coefficient used for correcting the detection brightness.

Figure 10:
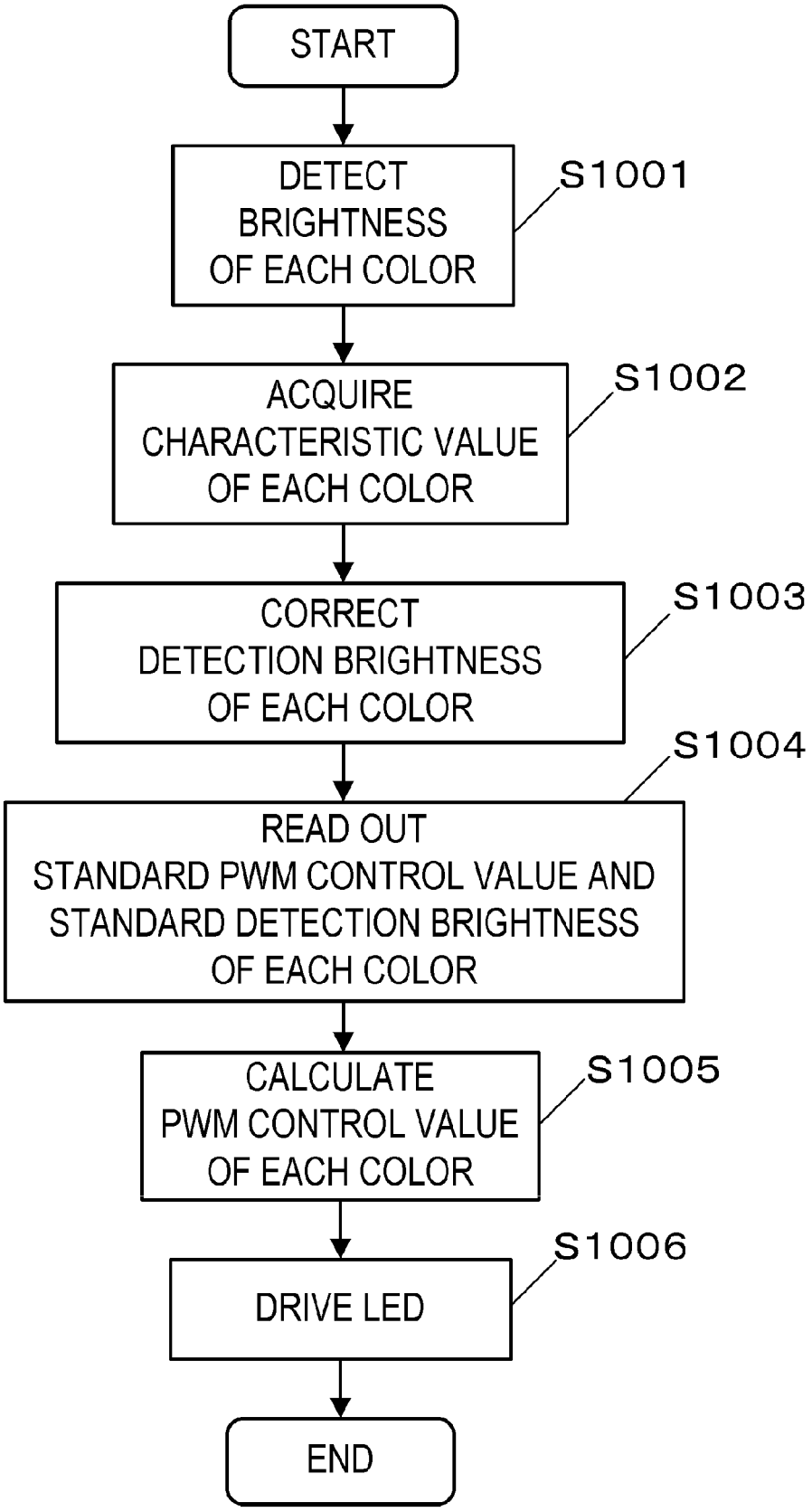
FIG. 10 is a flowchart showing an example of the feed-back control according to the second embodiment.

FIG. 10 is a flowchart showing an example of the feed-back control according to this embodiment.

First, the brightness sensor in the sensor unit 804 detects the brightness of the R, G and B light at the timing after when the PWM control values are updated (S1001). At the same time, the temperature sensor in the sensor unit 804 detects the temperature.

Then, the level analysis unit 104 acquires the characteristic values of R, G and B of the image, as the brightness of R, G and B of the image to be displayed in the corresponding area of the brightness sensor, for each of the brightness sensors (S1002). According to this embodiment, a mean value of the R value, a mean value of the G value and a mean value of the B value are acquired as the characteristic values.

Next, the detection value correction unit 107 determines the correction coefficients of R, G and B (an R correction coefficient, a G correction coefficient, and a B correction coefficient) according to the above-described method, for each of the brightness sensors. By using the correction coefficients of R, G and B determined as above, the detection value correction unit 107 corrects the brightness of R, G and B detected in the S1001 (R detection brightness, G detection brightness, and B detection brightness) for each of the brightness sensors (S1003). According to this embodiment, the detection brightness is corrected by using the Expressions 4-1 to 4-3.

$$(R\text{ detection brightness after correction})=(R\text{ detection brightness})\times(R\text{ correction coefficient}) \quad (4\text{-}1)$$

$$(G\text{ detection brightness after correction})=(G\text{ detection brightness})\times(G\text{ correction coefficient}) \quad (4\text{-}2)$$

$$(B\text{ detection brightness after correction})=(B\text{ detection brightness})\times(B\text{ correction coefficient}) \quad (4\text{-}3)$$

Then, in S1004 to S1006, the backlight control unit 108 controls the light emission brightness of the light source corresponding to each of the light emission colors, so that the corrected detection brightness coincides with the target value corresponding to the light emission color, for each of the light emission colors.

In the S1004, the backlight control unit 108 reads out from the ROM the standard PWM control values of R, G and B, and the standard detection brightness of R, G and B (standard R detection brightness, standard G detection brightness, and standard B detection brightness) for each of the divided areas.

In the S1005, the backlight control unit 108 calculates the PWM control values by using the standard PWM control values, the standard detection brightness, and the detection brightness after correction, for each of the divided areas.

According to this embodiment, the PWM control values of R, G and B are calculated by using the Expressions 5-1 to 5-3.

(PWM control value of $R$)=(Reference PWM control value of $R$)×((Light emission brightness of $R$ after correction)/(Reference light emission brightness of $R$)) (Expression 5-1)

(PWM control value of $G$)=(Reference PWM control value of $G$)×((Light emission brightness of $G$ after correction)/(Reference light emission brightness of $G$)) (Expression 5-2)

(PWM control value of $B$)=(Reference PWM control value of $B$)×((Light emission brightness of $B$ after correction)/(Reference light emission brightness of $B$)) (Expression 5-3)

In the S1006, the backlight control unit 108 drives the LEDs in the backlight 109 by using the PWM control values calculated in the S1005, for each of the divided areas. Specifically, the RLED is driven by using the PWM control value of R, the GLEDs are driven by using the PWM control value of G, and the BLED is driven by using the PWM control value of B.

According to this embodiment as described thus far, the brightness of each of the colors of light emitted by the light sources of the backlight is detected on the light-emitting surface. The detection brightness of each of the colors of light emitted by the light sources of the backlight is corrected based on the brightness of the color in the image. When the backlight has the plurality of light sources, whose light emission colors are different from each other, it is possible to detect the light emission brightness of the color with high precision, for each of the colors of light emitted by the light sources. Further, for each of the colors of light emitted by the light sources of the backlight, the light emission brightness of the light source emitting the light of the color is controlled, based on the detection brightness after correction of the color, and therefore, it is possible to constantly maintain the light emission brightness of the backlight.

Further, according to this embodiment, it is possible to detect the light emission brightness of the backlight with higher precision, as the detection brightness is corrected by giving consideration to the change in the transmittance depending on the temperature. Incidentally, the correction of the detection brightness by giving consideration to the change in the transmittance depending on the temperature may be applied to the structure of the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-216014, filed on Sep. 28, 2012, which is hereby incorporated by reference herein in its entirety.

What is claimed is:

1. A display apparatus comprising:

a light emitting unit configured to emit light;

a displaying unit configured to display an image on a screen by allowing the light from the light emitting unit to be transmitted therethrough at a transmittance based on an image signal, wherein the displaying unit comprises:

a user-facing surface that includes the screen from which the transmitted light is transmitted to a user; and a light-emitting-unit-facing surface facing the light emitting unit and differing from the user-facing surface, wherein light from the light emitting unit is incident on the light-emitting-unit-facing surface, and wherein a percentage of the incident light, which is emitted from the light emitting unit and is incident on the light-emitting-unit-facing surface, is transmitted to the user through the light-emitting-unit-facing surface and through the user-facing surface, and a percentage of the incident light is diffused by the displaying unit and then returned to radiate from the light-emitting-unit-facing surface, a first measuring unit provided on a light-emitting surface of the light emitting unit, that detects a detection brightness comprising the brightness of light received directly from the light-emitting surface and the brightness of the return light;

a correcting unit configured to correct the detection brightness which is the brightness detected by the first measuring unit, based on the brightness of the image displayed in a predetermined area corresponding to a position where the first measuring unit is provided; and a control unit configured to control the light emission brightness of the light emitting unit so that the detection brightness after correction by the correcting unit coincides with a predetermined target value, wherein the correcting unit reduces, so that a change in the detection brightness due to return light which is returned to radiate from the light-emitting-unit-facing surface is corrected, the detection brightness by a greater reduction amount, in a case where the image displayed in the predetermined area is dark, than a case where the image displayed in the predetermined area is bright, which is brighter than the dark image displayed in the predetermined area.

2. The display apparatus according to claim 1, further comprising a second measuring unit configured to detect a temperature near the first measuring unit, wherein the correcting unit reduces the detection brightness by a greater reduction amount, when the temperature detected by the second measurement unit is high, than when the temperature detected by the second measurement unit is low, which is lower than the detected high temperature.

3. The display apparatus according to claim 1, wherein the display apparatus operates in a plurality of modes having different target values of the detection brightness after correction by the correcting unit, and the correcting unit sets, as the predetermined area, an area whose size is larger when the target value corresponding to the set mode is great, than when the target value corresponding to the set mode is small, which is smaller than the great target value.

4. The display apparatus according to claim 1, wherein the predetermined area is an area centered on a position where the first measuring unit is provided.

5. The display apparatus according to claim 1, wherein the light emitting unit has a plurality of light sources having light emission colors that are different from each other, the first measuring unit detects the brightness on the light-emitting surface for each of the light emission colors emitted from the light sources, the correcting unit corrects the detection brightness of each of the colors, based on the brightness of the color of the image displayed in the predetermined area, and the control unit controls the light emission brightness of the light source corresponding to each of the colors so that the detection brightness after correction by the correcting unit coincides with a target value corresponding to the color.

6. The display apparatus according to claim 5, wherein the correcting unit sets, as the predetermined area, an area whose size is different for each of the colors.

7. A control method of a display apparatus including a light emitting unit configured to emit light, a displaying unit configured to display an image on a screen by allowing the light from the light emitting unit to be transmitted therethrough at a transmittance based on an image signal, and a first measuring unit, the displaying unit comprising a user-facing surface that includes the screen from which the transmitted light is transmitted to a user, and a light-emitting-unit-facing surface facing the light emitting unit and differing from the user-facing surface, wherein light from the light emitting unit is incident on the light-emitting-unit-facing surface, and wherein a percentage of the incident light, which is emitted from the light emitting unit and is incident on the light-emitting-unit-facing surface is, transmitted to the user through the light-emitting-unit-facing surface and through the user-facing surface, and a percentage of the incident light is diffused by the displaying unit and then returned to radiate from the light-emitting-unit-facing surface, wherein the first measuring unit is provided on a light-emitting surface of the light emitting unit and detects a detection brightness comprising the brightness of light received directly from n the light-emitting surface and the brightness of the return light, the control method comprising the steps of:

correcting the detection brightness, which is the brightness detected by the first measuring unit, based on the brightness of the image displayed in a predetermined area corresponding to a position where the first measuring unit is provided; and controlling the light emission brightness of the light emitting unit so that the detection brightness after correction in the correcting step coincides with a predetermined target value, wherein in the correcting step, correction occurs so that a change in the detection brightness due to the return light which is returned to radiate from the light-emitting-unit-facing surface is corrected, and the detection brightness is reduced by a greater reduction amount, when the image displayed in the predetermined area is dark, than when the image displayed in the predetermined area is bright, which is brighter than the dark image displayed in the predetermined area.

8. The control method according to claim 7, wherein the display apparatus further includes a second measuring unit configured to detect a temperature near the first measuring unit, and in the correcting step, the detection brightness is reduced by a greater reduction amount, when the temperature detected by the second measurement unit is high, than when the temperature detected by the second measurement unit is low, lower than the detected high temperature.

9. The control method according to claim 7, wherein the display apparatus has a plurality of modes having different target values of the detection brightness after correction, and in the correcting step, an area whose size is larger when the target value corresponding to the set mode is great, than when the target value corresponding to the set mode is small is set as the predetermined area, where the small target value is smaller than the great target value.

10. The control method according to claim 7, wherein the predetermined area is an area centered on a position where the first measuring unit is provided.

11. The control method according to claim 7, wherein the light emitting unit has a plurality of light sources having light emission colors that are different from each other, the first measuring unit detects the brightness on the light-emitting surface for each of the light emission colors emitted from the light sources, in the correcting step, the detection brightness of each of the colors is corrected based on the brightness of the color of the image displayed in the predetermined area, and in the controlling step, the light emission brightness of the light source corresponding to each of the colors is controlled so that the detection brightness after correction coincides with a target value corresponding to the color.

12. The control method according to claim 11, wherein in the correcting step, an area whose size is different for each of the colors is set as the predetermined area.

* * * * *